US008347985B2

(12) United States Patent
Bittar et al.

(10) Patent No.: US 8,347,985 B2
(45) Date of Patent: Jan. 8, 2013

(54) MULITMODAL GEOSTEERING SYSTEMS AND METHODS

(75) Inventors: Michael S. Bittar, Houston, TX (US); Jennifer Market, Spring, TX (US); Clive Menezes, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/679,502

(22) PCT Filed: Apr. 25, 2008

(86) PCT No.: PCT/US2008/061571

§ 371 (c)(1), (2), (4) Date: Mar. 23, 2010

(87) PCT Pub. No.: WO2009/131584

PCT Pub. Date: Oct. 29, 2009

(65) Prior Publication Data

US 2011/0180327 A1 Jul. 28, 2011

(51) Int. Cl.
*E21B 47/00* (2012.01)

(52) U.S. Cl. ..... 175/61; 324/303; 324/347

(58) Field of Classification Search ..... 175/61; 324/303, 332, 347

See application file for complete search history.

(56) References Cited

U.S. PATENT DOCUMENTS

| | | | | |
|---|---|---|---|---|
| 5,243,290 | A | 9/1993 | Safinya et al. | |
| 5,389,881 | A | 2/1995 | Bittar et al. | |
| 5,720,355 | A | 2/1998 | Lamine et al. | |
| 6,084,826 | A * | 7/2000 | Leggett, III | 367/82 |
| 6,163,155 | A | 12/2000 | Bittar | |
| 6,191,586 | B1 | 2/2001 | Bittar | |
| 6,206,108 | B1 | 3/2001 | MacDonald et al. | |
| 6,218,842 | B1 | 4/2001 | Bittar | |
| 6,353,321 | B1 | 3/2002 | Bittar | |

(Continued)

FOREIGN PATENT DOCUMENTS

| | | |
|---|---|---|
| EP | 0654687 | 5/1995 |

(Continued)

OTHER PUBLICATIONS

PCT International Search Report and Written Opinion, dated Aug. 15, 2008, Appl No. PCT/US08/61571, "Multimodal Geosteering Systems and Methods", filed Apr. 25, 2008, 8 pgs.

(Continued)

*Primary Examiner* — William P Neuder
(74) *Attorney, Agent, or Firm* — Krueger Iselin LLP

(57) ABSTRACT

Multimodal geosteering systems and methods are disclosed. Some disclosed tool embodiments include first and second transmitter-receiver arrangements that make geosteering measurements using different forms of energy (such as acoustic and electromagnetic energy) to provide geosteering measurements that at least indicate a boundary direction but may also indicate a boundary distance. Some disclosed method embodiments include: determining a direction to a bed boundary using measurements with different energy types; and adjusting a drilling direction based at least in part on said determination. Combinations of (or selections between) the different measurements may be made based on, inter alia, measurement range, resolution, and contrast. Some disclosed system embodiments include a memory and a processor. The memory stores geosteering display software that configures the processor to generate an image with different regions based on the different types of geosteering measurements. Characteristics such as opacity, resolution, and intensity may visually distinguish the different regions.

21 Claims, 5 Drawing Sheets

U.S. PATENT DOCUMENTS

| | | | |
|---|---|---|---|
| 6,359,438 | B1 | 3/2002 | Bittar |
| 6,476,609 | B1 | 11/2002 | Bittar |
| 6,538,447 | B2 | 3/2003 | Bittar |
| 6,727,706 | B2 | 4/2004 | Gao et al. |
| 6,810,331 | B2 | 10/2004 | Bittar et al. |
| 6,885,943 | B2 | 4/2005 | Bittar et al. |
| 6,911,824 | B2 | 6/2005 | Bittar |
| 6,944,546 | B2 | 9/2005 | Xiao et al. |
| 7,019,528 | B2 | 3/2006 | Bittar |
| 7,038,455 | B2 | 5/2006 | Beste et al. |
| 7,046,010 | B2 | 5/2006 | Hu et al. |
| 7,098,664 | B2 | 8/2006 | Bittar et al. |
| 7,098,858 | B2 | 8/2006 | Bittar et al. |
| 7,138,803 | B2 | 11/2006 | Bittar |
| 7,202,670 | B2 | 4/2007 | Omeragic et al. |
| 7,227,363 | B2 | 6/2007 | Gianzero et al. |
| 7,265,552 | B2 | 9/2007 | Bittar |
| 7,296,462 | B2 | 11/2007 | Gregory et al. |
| 7,345,487 | B2 | 3/2008 | Bittar et al. |
| 7,350,568 | B2 | 4/2008 | Mandal et al. |
| 7,427,863 | B2 | 9/2008 | Bittar |
| 7,557,579 | B2 | 7/2009 | Bittar |
| 7,557,580 | B2 | 7/2009 | Bittar |
| 7,659,722 | B2 | 2/2010 | Bittar |
| 7,786,733 | B2 | 8/2010 | Seydoux et al. |
| 7,848,887 | B2 | 12/2010 | Yang et al. |
| 8,222,902 | B2 | 7/2012 | Bittar et al. |
| 2003/0018433 | A1 | 1/2003 | Blanch et al. |
| 2003/0229450 | A1 | 12/2003 | Strickland |
| 2004/0027131 | A1 | 2/2004 | Bittar |
| 2004/0145503 | A1 | 7/2004 | Blanch et al. |
| 2005/0024060 | A1 | 2/2005 | Bittar |
| 2005/0099184 | A1 | 5/2005 | Gianzero et al. |
| 2005/0251342 | A1 | 11/2005 | Market et al. |
| 2006/0022887 | A1 | 2/2006 | Bittar |
| 2006/0102353 | A1 | 5/2006 | Storm et al. |
| 2006/0244455 | A1 | 11/2006 | Bittar |
| 2006/0255811 | A1 | 11/2006 | Bittar et al. |
| 2007/0079989 | A1 | 4/2007 | Bankston et al. |
| 2007/0205021 | A1 | 9/2007 | Pelletier et al. |
| 2007/0229082 | A1 | 10/2007 | Vehra et al. |
| 2007/0235225 | A1 | 10/2007 | Bittar |
| 2008/0078580 | A1 | 4/2008 | Bittar |
| 2008/0173481 | A1 | 7/2008 | Menezes et al. |
| 2008/0252296 | A1 | 10/2008 | Hu et al. |
| 2008/0315884 | A1 | 12/2008 | Bittar et al. |
| 2009/0015260 | A1 | 1/2009 | Bittar |
| 2009/0045973 | A1 | 2/2009 | Rodney et al. |
| 2009/0224764 | A1 | 9/2009 | Bittar |
| 2009/0230968 | A1 | 9/2009 | Bittar et al. |
| 2009/0278543 | A1 | 11/2009 | Beste et al. |
| 2009/0302851 | A1 | 12/2009 | Bittar et al. |
| 2009/0309798 | A1 | 12/2009 | Bittar et al. |
| 2010/0127708 | A1 | 5/2010 | Bittar |
| 2011/0006773 | A1 | 1/2011 | Bittar |
| 2011/0019501 | A1* | 1/2011 | Market ..... 367/34 |
| 2011/0180327 | A1 | 7/2011 | Bittar et al. |
| 2011/0251794 | A1 | 10/2011 | Bittar et al. |
| 2011/0309835 | A1 | 12/2011 | Barber et al. |

FOREIGN PATENT DOCUMENTS

| | | |
|---|---|---|
| WO | WO2009/073008 | 6/2009 |

OTHER PUBLICATIONS

Bell, C. et al., "Navigating and Imaging in Complex Geology With Azimuthal Propagation Resistivity While Drilling", 2006 SPE Annual Technical Conference and Exhibition, SPE 102637, San Antonio, TX, USA, (Sep. 24, 2006),pp. 1-14.

Luling, Martin et al., "Processing and Modeling 2-MHz Resistivity Tools", SPWLA 35th Annual Logging Symposium, Paper QQ, Jun. 19-22, 1994, pp. 1-25.

Li, Qiming et al., "New Directional Electromagnetic Tool for Proactive Geosteering and Accurate Formation Evaluation While Drilling", SPWLA 46th Annual Logging Symposium, Paper UU, Jun. 26-29, 2005, pp. 1-16.

Bonner, Steve et al., "Resistivity While Drilling—Images from the String", Oilfield Review, Spring 1996, pp. 4-19.

Barriol, Yves et al., "The Pressures of Drilling and Production", Oilfield Review, Autumn 2005, pp. 22-41.

Chou, Lawrence et al., "Steering Toward Enhanced Production", Oilfield Review, Autumn 2006, pp. 54-63.

Moran, J. H. et al., "Effects of formation anisotropy on resistivity-logging measurements", Geophysics, vol. 44, No. 7 (Jul. 1979): p. 1266-1286, 21 Figs., 4 Tables., 21 pgs.

* cited by examiner

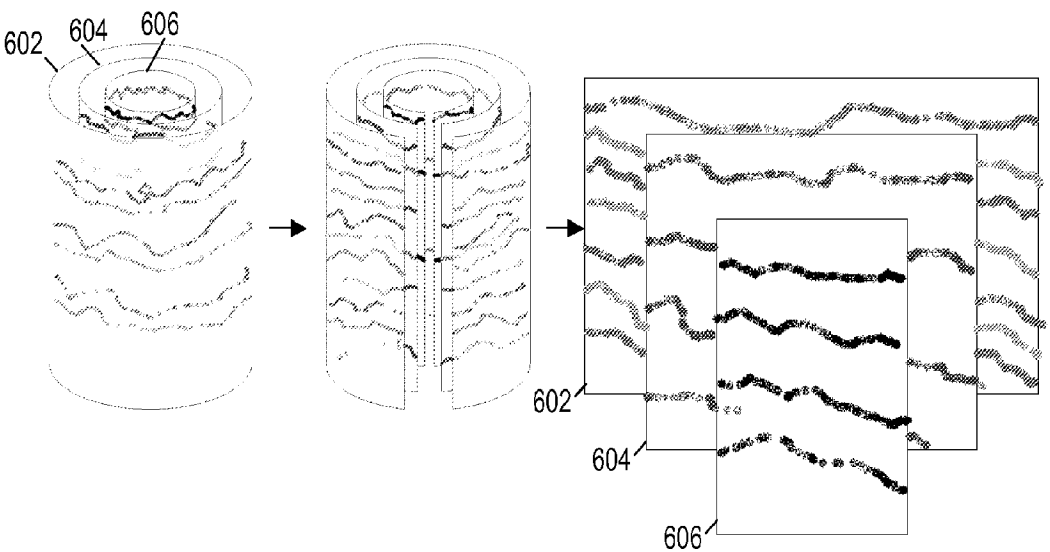
FIG. 6A
FIG. 6B
FIG. 6C
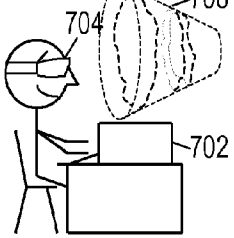
FIG. 7A
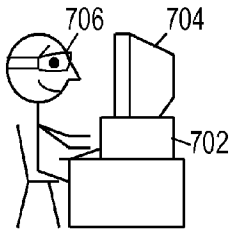
FIG. 7B
FIG. 7C
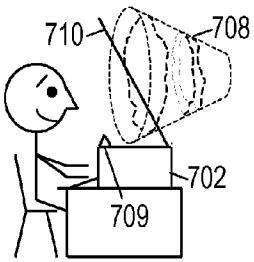
FIG. 7D

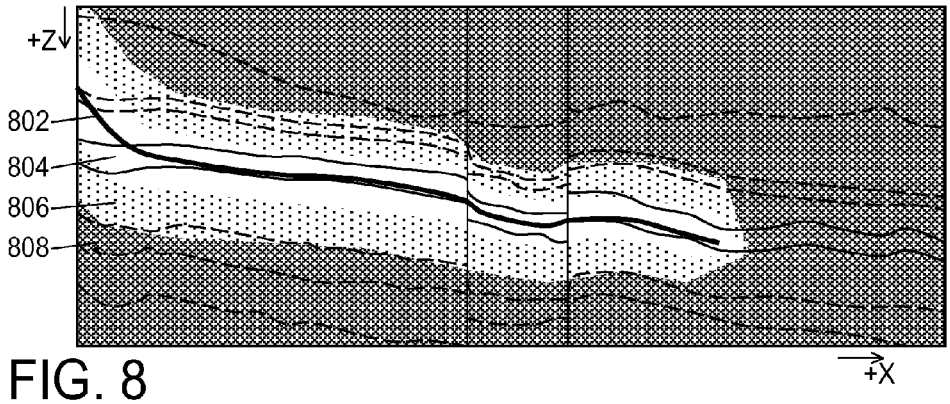
FIG. 8
FIG. 9
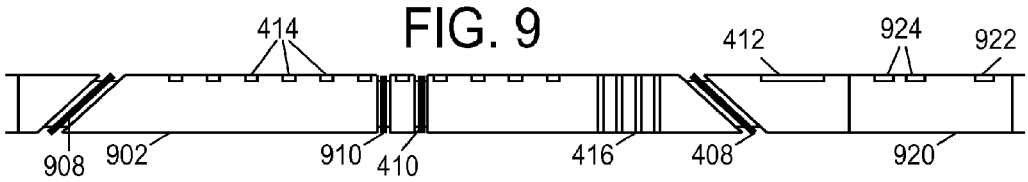
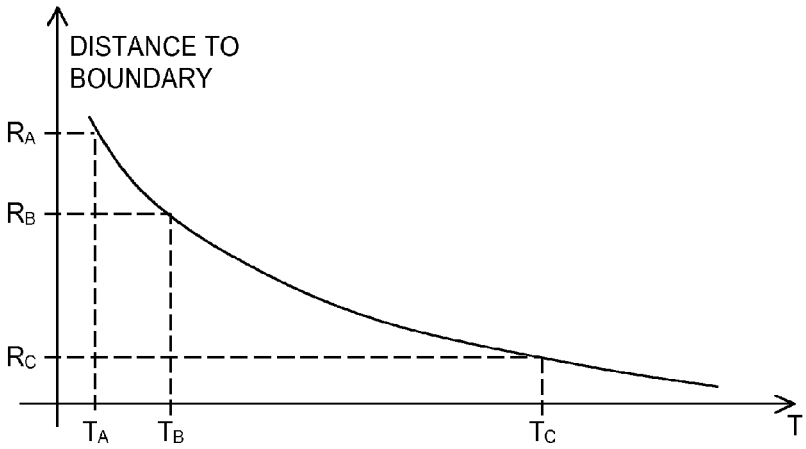
FIG. 10

MULITMODAL GEOSTEERING SYSTEMS AND METHODS

BACKGROUND

In the field of petroleum well drilling and logging, resistivity-logging tools are frequently used to provide an indication of the electrical resistivity of rock formations surrounding an earth borehole. Such information regarding resistivity is useful in ascertaining the presence or absence of hydrocarbons. A typical resistivity-logging tool includes a transmitter antenna and a pair of receiver antennas located at different distances from the transmitter antenna along the axis of the tool. The transmitter antenna is used to create electromagnetic fields in the surrounding formation. In turn, the electromagnetic fields in the formation induce an electrical voltage in each receiver antenna. Due to geometric spreading and absorption by the surrounding earth formation, the induced voltages in the two receiving antennas have different phases and amplitudes.

Experiments have shown that the phase difference (Φ) and amplitude ratio (attenuation, A) of the induced voltages in the receiver antennas are indicative of the resistivity of the formation. The formation region (as defined by a radial distance from the tool axis) to which such a resistivity measurement pertains is a function of the frequency of the transmitter and the distance from the transmitter to the mid-point between the two receivers. Thus, one may achieve multiple radial depths of investigation of resistivity either by providing multiple transmitters at different distances from the receiver pair or by operating a given transmitter at multiple frequencies, or both.

In addition to varying depths of investigation, resistivity logging tools may be provided with a directional sensitivity by tilting one or more of the transmitter and receiver antennas as described in U.S. Pat. No. 7,265,552 to Michael Bittar. As explained in the Bittar patent, if the resistivities corresponding to the various rotational orientations are different, such differences often indicate the direction of a boundary between formations having different resistivities. In directional drilling, it is often the goal to steer the drill into a formation bed and to "follow" (to drill substantially parallel to) one of the boundaries of the bed to maximize the extent of the borehole within the bed. When implemented as logging-while-drilling ("LWD") tools, the directional resistivity-logging tools provide valuable measurements for such geosteering applications.

Existing resistivity measurement tools for geosteering provide measurement ranges of up to 6 m (20 ft), which may not be enough in many situations. Moreover, such tools may not perform well in the oil fields of Saudi Arabia, where resistivity logs exhibit poor contrasts. Halliburton has recently proposed an acoustic measurement technique as an alternative basis for geosteering. The acoustic tool may provide a measurement range of up to 15 m (50 ft).

BRIEF DESCRIPTION OF THE DRAWINGS

A better understanding of the various disclosed embodiments can be obtained when the following detailed description is considered in conjunction with the accompanying drawings, in which:

FIGS. 6A-6C show illustrative geosteering tool measurements in the form of cylindrical shells;

FIGS. 7A-7D show illustrative three-dimensional imaging systems suitable for viewing geosteering tool measurements;

FIG. 8 shows an alternative view for displaying geosteering tool measurements with respect to a borehole;

FIG. 9 shows an alternative multimode geosteering tool embodiment;

FIG. 10 is an illustrative graph of boundary distance versus time; and

Figure 1:
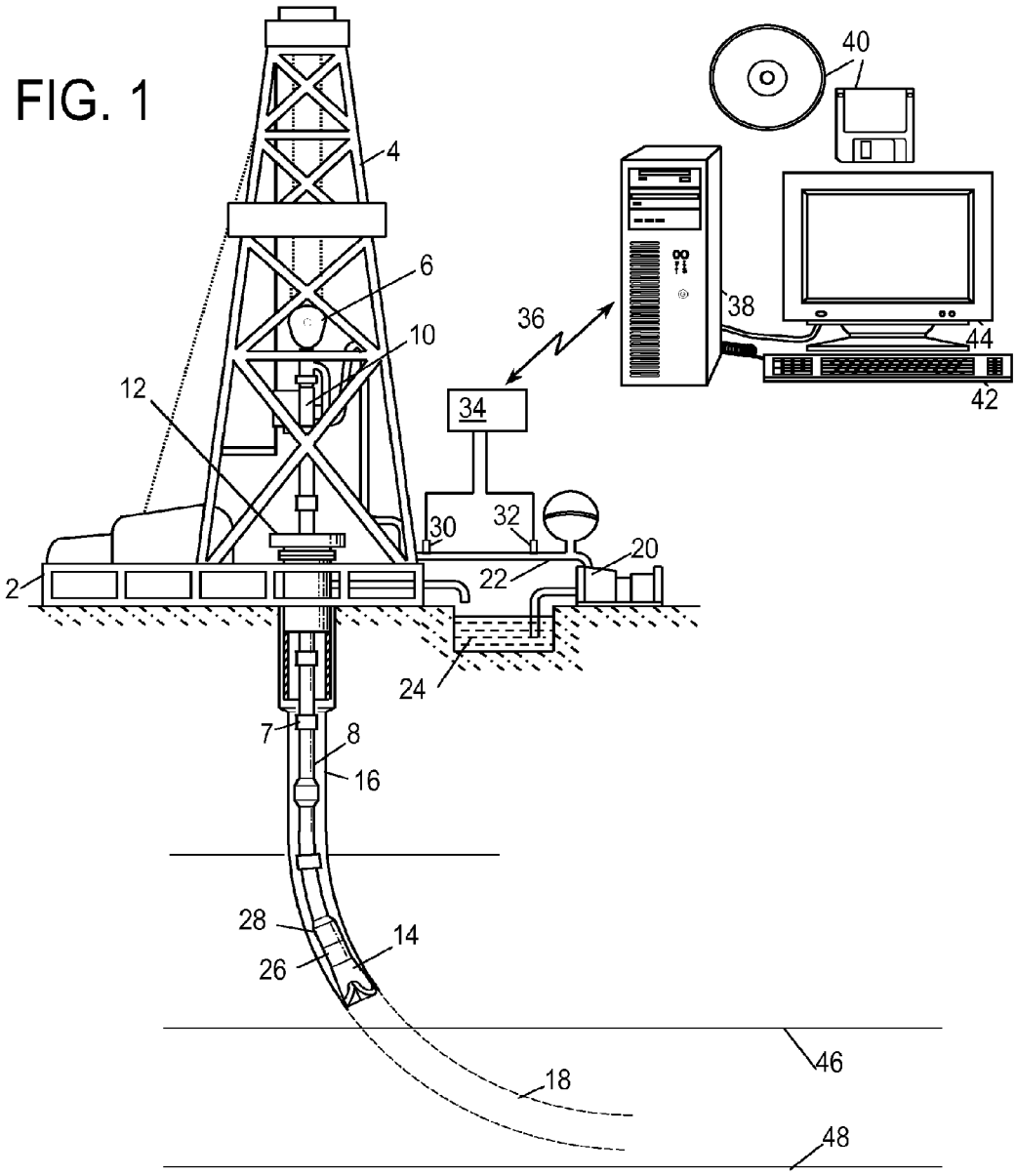
FIG. 1 shows a drilling environment in which geosteering may be employed.

While the invention is susceptible to various modifications and alternative forms, specific embodiments thereof are shown by way of example in the drawings and will herein be described in detail. It should be understood, however, that the drawings and detailed description are not intended to limit the invention to the particular form disclosed, but on the contrary, the intention is to cover all modifications, equivalents and alternatives falling within the spirit and scope of the present invention as defined by the appended claims.

DETAILED DESCRIPTION

Disclosed herein are various multimodal geosteering systems and methods. Some of the disclosed system embodiments include a downhole tool that makes geosteering measurements of at least two different types, e.g., measurements made with different forms energy. The geosteering measurement types employed by the foregoing systems and methods may include measurements of acoustic impedance, acoustic slowness, electrical resistivity, porosity, permeability, and density, among others. The geosteering measurements may be selectively communicated to the surface and/or selectively displayed to the driller based on programmable selection criteria such as distance to a detected boundary, measurement contrast, tool resolution, display scale, or user preferences. Alternatively the boundary measurements may be overlaid or combined to provide as much information as possible to aid the geosteering process.

In at least some of the disclosed method embodiments, a downhole tool makes geosteering measurements with two or more different forms of energy. As boundaries are detected by the different measurement types, the tool (or the control system at the surface) combines the measurements or selects a subset of the measurements for communication to the surface and/or display to the driller. The method embodiments may rely on a number of bases for combining or selecting the different geosteering measurement types, including range, resolution, accuracy, contrast, and user preferences.

The disclosed tool configurations and operations are best understood in the context of the larger systems in which they operate. Accordingly, an illustrative geosteering environment is shown in FIG. 1. A drilling platform 2 supports a derrick 4 having a traveling block 6 for raising and lowering a drill string 8. A top drive 10 supports and rotates the drill string 8 as it is lowered through the wellhead 12. A drill bit 14 is driven by a downhole motor and/or rotation of the drill string 8. As bit 14 rotates, it creates a borehole 16 that passes through various formations.

The drill bit 14 is just one piece of a bottom-hole assembly that typically includes one or more drill collars (thick-walled steel pipe) to provide weight and rigidity to aid the drilling process. Some of these drill collars may include logging instruments to gather measurements of various drilling parameters such as position, orientation, weight-on-bit, borehole diameter, etc. The tool orientation may be specified in terms of a tool face angle (rotational orientation), an inclination angle (the slope), and compass direction, each of which can be derived from measurements by magnetometers, inclinometers, and/or accelerometers, though other sensor types such as gyroscopes may alternatively be used. In one specific embodiment, the tool includes a 3-axis fluxgate magnetometer and a 3-axis accelerometer. As is known in the art, the combination of those two sensor systems enables the measurement of the tool face angle, inclination angle, and compass direction. In some embodiments, the tool face and hole inclination angles are calculated from the accelerometer sensor output. The magnetometer sensor outputs are used to calculate the compass direction.

A geosteering system further includes a tool 26 to gather measurements of formation properties from which boundary detection signals can be derived. Using these measurements in combination with the tool orientation measurements, the driller can steer the drill bit 14 along a desired path 18 using any one of various suitable directional drilling systems, including steering vanes, a "bent sub", and a rotary steerable system.

A pump 20 circulates drilling fluid through a feed pipe 22 to top drive 10, downhole through the interior of drill string 8, through orifices in drill bit 14, back to the surface via the annulus around drill string 8, and into a retention pit 24. The drilling fluid transports cuttings from the borehole into the pit 24 and aids in maintaining the borehole integrity. Moreover, a telemetry sub 28 coupled to the downhole tools 26 can transmit telemetry data to the surface via mud pulse telemetry. A transmitter in the telemetry sub 28 modulates a resistance to drilling fluid flow to generate pressure pulses that propagate along the fluid stream at the speed of sound to the surface. One or more pressure transducers 30, 32 convert the pressure signal into electrical signal(s) for a signal digitizer 34. Note that other forms of telemetry exist and may be used to communicate signals from downhole to the digitizer. Such telemetry may employ acoustic telemetry, electromagnetic telemetry, or telemetry via wired drillpipe.

The digitizer 34 supplies a digital form of the pressure signals via a communications link 36 to a computer 38 or some other form of a data processing device. Computer 38 operates in accordance with software (which may be stored on information storage media 40) and user input via an input device 42 to process and decode the received signals. The resulting telemetry data may be further analyzed and processed by computer 38 to generate a display of useful information on a computer monitor 44 or some other form of a display device. For example, a driller could employ this system to obtain and monitor drilling parameters, formation properties, and the path of the borehole relative to detected formation boundaries 46 and 48.

Figure 2:
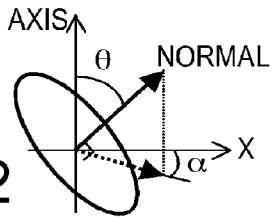
FIG. 2 shows a coordinate system for specifying antenna tilt.
Figure 3:
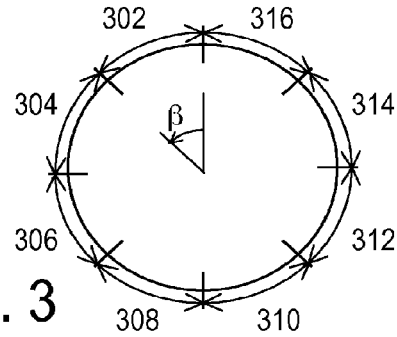
FIG. 3 shows a borehole cross-section divided into azimuthal sectors.

In at least some embodiments, the multimodal geosteering tools of the present disclosure employ tilted antennas for electromagnetic resistivity measurements such as those disclosed by Michael Bittar in U.S. Pat. No. 7,265,552. As shown in FIG. 2, the orientation of such tilted antennas can be specified in terms of a tilt angle $\theta$ and a rotational angle $\alpha$. The tilt angle is the angle between the tool axis and the normal vector for the antenna. The rotational angle $\alpha$ is the angle between the tool face scribe line and the projection of the normal vector. As the tool rotates, the tilted antenna(s) gain measurement sensitivity in different azimuthal directions from the borehole, and these measurements can be made as a function of the azimuthal angle. FIG. 3 shows a borehole circumference divided into azimuthal sectors 302-316, corresponding to ranges of azimuthal angles. The azimuthal angle $\beta$ is defined relative to the "high-side" of the borehole (or, in substantially vertical wells, relative to the north-side of the borehole). When the tool is centered in the borehole, the azimuthal angle $\beta$ preferably corresponds to the position of the tool face scribe line. In some embodiments, angular corrections are applied to the rotational orientations of de-centralized tools when associating measurements with an azimuthal sector. Though eight sectors are shown in the figure, the actual number of sectors may vary between 4 and the highest resolution the tool will support.

Figure 4:
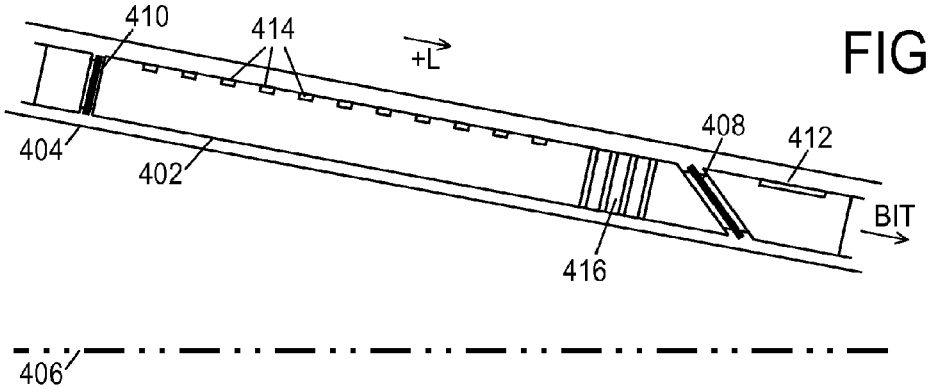
FIG. 4 shows an illustrative multimode geosteering tool approaching a bed boundary.

FIG. 4 shows an illustrative multimodal geosteering tool 402 in a borehole 404 approaching a bed boundary 406. The illustrated multimodal tool includes multiple transmitter-receiver arrangements to utilize different forms of energy to make geosteering measurements of different types. Antennas 408, 410 make azimuthally-sensitive resistivity measurements, and an acoustic source 412 and an array of acoustic receivers 414 make azimuthally-sensitive acoustic slowness measurements.

The resistivity measurements may be made in accordance with the techniques disclosed in previously-cited U.S. Pat. No. 7,265,552. Specifically, a transmitter coil 408 transmits an electromagnetic wave that propagates through the formation surrounding the borehole, thereby generating a signal in a receiving coil 410. In the illustrative embodiment, the transmitter coil 408 is tilted to provide azimuthal sensitivity, but such sensitivity can alternatively or additionally be supplied by tilting the receiver coil 410. Multiple transmitter and/or receiver coils may be employed to improve measurement accuracy and provide multiple depths of investigation. From the measurements of signal attenuation and phase shift, it becomes possible to determine azimuthal resistivity measurements and boundary detection signals. (A number of suitable boundary detection signal determination methods are disclosed in U.S. patent application Ser. No. 11/835,619, filed Aug. 8, 2007 and entitled "Tool for Azimuthal Resistivity Measurement and Bed Boundary Detection.)

The acoustic measurements may be made in accordance with the techniques disclosed in U.S. patent application Ser. No. 12/595,294, filed May 23, 2001 and entitled "Acoustic Radial Profiling via Frequency Domain Processing" by inventor Jennifer Market. Specifically, an acoustic source 412 transmits an acoustic wave that propagates through the formation surrounding the borehole and generates signals in the acoustic detectors 414 arranged along the length of the tool. An acoustic isolator 416 may be included to attenuate and delay the acoustic wave that propagates within the tool body. Because the acoustic isolator 416 also attenuates vibration from the drill bit, the bulk of the tool electronics and receivers may be located up-string from the isolator.

A directional acoustic source 412 and/or directional acoustic detectors 414 are employed to provide azimuthal sensitivity to the acoustic measurements. Sufficient directionality may be achieved by simply positioning the source and detectors flush on one side of the tool as shown in FIG. 4. However, additional directionality can be obtained with array processing using detectors on multiple sides of the tool, and/or by mounting the transducers in recesses so that apertures over the transducers can be used to narrow the sound field.

Semblance processing for acoustic logging tools is well known as a technique for measuring the slowness (inverse velocity, measured in units of length per unit of time) of acoustic waves propagating in the formation. Various suitable techniques exist for determining semblance as a function of frequency and slowness (see, e.g., the previously-cited Market application, and B. Mandal, U.S. Pat. No. 7,099,810, among others). Correlation and covariance determinations are closely related to semblance and may be used as alternatives to the semblance calculation.

At each given frequency, peaks in the semblance function will indicate the slowness of the acoustic waves having that frequency. The general range of the slowness value is usually indicative of the wave type (shear wave, pressure wave, etc.), and the specific slowness value is characteristic of the formation through which it travels. Moreover, because the wavelength $\lambda$ of acoustic waves is $\lambda=1/sf$, where s is slowness and f is frequency, the semblance function S(f,s) can be transformed into a function of wavelength and slowness by a simple substitution:

$$\tilde{S}(\lambda, s) = S\left(\frac{1}{s\lambda}, s\right).$$

This transformed function is particularly useful because the depth of investigation provided by a given acoustic wavelength is roughly equal to the wavelength. Thus the semblance peaks in the transformed function characterize the formation at different depths of investigation. If the acoustic tool generates frequencies as low as 100 Hz, the depth of investigation may extend approximately 15 m (50 ft) into the formation.

When azimuthally-sensitive measurements are made, the acoustic tool can provide a three dimensional map of the formation around the borehole, though perhaps not with the same resolution that is achievable using the electromagnetic resistivity measurements. Such a map can be used to detect the tool's approach toward (or retreat away from) a boundary between the current formation bed and a neighboring layer, preferably with sufficient range so that the driller has time to adjust the borehole path to follow the boundary.

Figure 5:
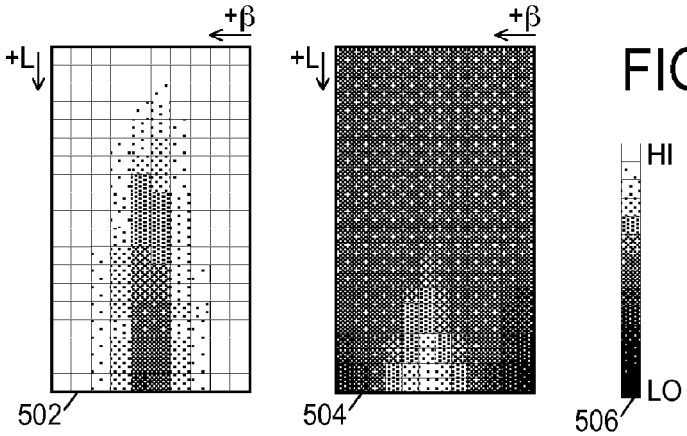
FIG. 5 shows illustrative geosteering tool measurements in the form of two-dimensional images.

FIG. 5 shows illustrative "images" or two-dimensional maps of signal values as a function of azimuthal angle $\beta$ and tool position L. Illustrative image 502 represents the measurements of acoustic slowness at a given depth of investigation, while illustrative image 504 represents a bed boundary indicator signal derived from the tilted antenna measurements. An arbitrary scale 506 illustrates how the intensity or color of an image pixel can be used to represent a property measurement or signal value at a given tool position and orientation.

Image 502 illustrates a change in acoustic slowness measurements centered in the direction of the "low-side" of the borehole as the tool progresses along the borehole, representing the acoustic tool's detection of the approaching bed boundary. Image 504 illustrates a change in bed boundary indicator signal value as the tool progresses along the borehole, representing the tilted antenna tool's detection of the approaching bed boundary. In this example, the tilted antenna tool offers a better image resolution, but its detection of the bed boundary lags behind the acoustic tool's detection of the approaching bed boundary. This detection lag may be a result of the acoustic tool's greater measurement range.

FIGS. 6A-6C illustrate the relationship between the two-dimensional image representation and a three-dimensional cylindrical shell representation of tool measurements when such measurements can be made as a function of tool position, borehole azimuth, and radial depth of investigation. The images in FIG. 5 represent the outermost shell 602, i.e., the deepest depth of investigation for each measurement type. However, there may also be measurements available for shallower depths of investigation, as represented by intermediate shell 604 and inner shell 606. This additional information can be used to aid in the interpretation of the outermost shell and to simplify comparisons between tools having different ranges (e.g., the resistivity measurements may be compared or combined with acoustic measurements having the same depth of investigation).

FIGS. 7A-7D show various illustrative visualization techniques for displaying three-dimensional measurement data around the borehole to aid the driller in making geosteering decisions. In FIG. 7A, a computer 702 displays a representation of the three-dimensional measurements on a display 704. Animation, possibly in conjunction with a cut-away or cross-sectional view, illustrates the volumetric representation of the measurement data, enabling the user to detect property changes that may indicate an approaching bed boundary. In some embodiments, the measurements may be preprocessed to display areas of relatively constant, unchanging values with a high degree of transparency, whereas discontinuities or areas having large gradients are shown with a high degree of opacity. Such preprocessing may simplify the detection of bed boundaries and aid in geosteering decisions.

In FIG. 7B, polarized or filter goggles 706 are used to control the image seen by the user's left and right eyes, enabling the computer 702 to generate a perception of three-dimensions using two alternating or overlaid two-dimensional images. This perception of three dimensions may greatly aid the user's understanding of the spatial relationships in the data. As before, the computer 702 may employ animation, cut-away views, and/or preprocessing to further illustrate the interrelationships of the tool measurements.

In FIG. 7C, viewing goggles 704 display left and right images to the corresponding eye, thereby providing three-dimensional perception similar to the approach in FIG. 7B. However, because filtering and/or switching is unnecessary, the fidelity of the perceived image 708 may be substantially improved. In FIG. 7D, a holographic projector 709 and screen 710 create the perceived image 708 holographically without need of goggles, perhaps providing a more natural viewing experience for the user. These and other viewing techniques may enable the driller to "see" the boundaries in the formations being penetrated by the drillstring with sufficient resolution and range to optimize the borehole path. As with the two-dimensional view, the three-dimensional image can be given a sharp resolution near the borehole and a reduced resolution at greater distances.

FIG. 8 shows an illustrative "vertical section" view, showing the borehole path 802 as a function of depth Z and horizontal extent X. Note that because the borehole path is not necessarily contained in a plane, the instantaneous direction of X may vary within the horizontal plane. FIG. 8 includes an innermost data region 804 proximate to the borehole path 802, an intermediate data region 806 outside the innermost data region, and a remote data region beyond the intermediate data region. In this example, the remote data region may be defined as the region outside the range of the acoustic tool, and the intermediate data region may be defined as the region outside the range of the electromagnetic tool, but inside the range of the acoustic tool. The number and definition of these regions may vary based on the number, range, and resolution of the geosteering measurement types incorporated into the drill string.

In this example, the remote data region 808 may show only measurements and/or boundaries derived from seismic survey data. The intermediate data region 806 may additionally show measurements and/or boundaries derived from the acoustic slowness measurements. The innermost data region 804 may additionally show measurements and/or boundaries derived from electromagnetic resistivity measurements. FIG. 8 shows these regions with different degrees of shading for illustrative purposes. Although such shading can be used in practice, it is more likely that color intensity (or opacity) would be used to mark the various regions, with the intensity (or opacity) increasing with proximity to the borehole path. Alternatively, or additionally, the displayed resolution may increase with proximity to the borehole path. The change in resolution may be perceived as fuzzier boundary indications at greater distances from the borehole path, and this effect may be intentionally created with "smoothing" of the data measurements.

In some embodiments, all of the available geosteering data will be overlaid (or possibly combined using a weighted average) on the display, possibly with the option for the user to toggle on and off the display of measurements from each source. Such toggling provides the user with one way to determine the source of a given boundary or measurement, or enables the user to eliminate unhelpful information from the display. In other embodiments, the availability of better measurement data (optionally defined as data having a higher resolution or a better measurement contrast) in a given region will cause the system to display that data to the exclusion of less helpful data. Thus the displayed data may progress from one measurement type to another across the data regions. In any event, the driller may be provided with measurements that enable the clearest understanding of the formations through which the drill string is progressing.

FIG. 9 shows another illustrative geosteering tool assembly 902. In assembly 902, geosteering measurements are obtained using three different forms of energy. Acoustic geosteering measurements are provided as before by acoustic source 412 and the array of acoustic detectors 414. Electromagnetic resistivity measurements are provided by tilted transmitter antennas 408, 908, and receiver antennas 410, 910. In the configuration of FIG. 9, the electromagnetic resistivity antenna configuration employs two receiver antennas to provide differential measurements of phase and/or attenuation. The configuration further includes tilted transmitter antennas symmetrically positioned relative to the receivers to enable compensated measurements. Multiple transmit signal frequencies can be used to obtain measurements with different depths of investigation, and it is known that transmitter and receiver roles can be exchanged using reciprocity principles. Simultaneous or iterative transmitter firings can be equivalently used in accordance with the principles of superposition. The number and orientations of the transmitter and receiver antennas can be varied to obtain similarly useful azimuthal resistivity measurements. Steerable antenna configurations are known and are also suitable for use in this system.

The assembly of FIG. 9 further includes a sub 920 for making density, porosity, and/or permeability measurements. Illustrative sub 920 includes a gamma ray source 922 and two gamma ray detectors 924 to enable formation density measurements. Sub 920 may be augmented or replaced by a pulsed neutron tool and/or a nuclear magnetic resonance (NMR) logging tool. Such tools are expected to achieve measurement ranges of between 5 cm (2 in) to 40 cm (16 inches), preferably with at least some azimuthal sensitivity.

FIG. 10 is a graph of a multimodal geosteering tool's illustrative approach toward a boundary. The distance to a boundary is shown as a function of time. Initially, the boundary is outside the detection range of each of the geosteering measurement types, but its location may be generally known from seismic data or logging data from other wells. At time $T_A$, the distance falls within $R_A$, the range of measurement type A (e.g., the acoustic tool), so that the boundary is detected and can be tracked using this geosteering measurement type as the tool approaches the boundary. At time $T_B$, the distance to the boundary falls below $R_B$, the range of measurement type B (e.g., the electromagnetic resistivity tool), and at time $T_C$, the distance falls below $R_C$, the range of measurement type C (e.g., the NMR tool).

As the boundary is detected by increasingly precise technologies, the system can switch between geosteering techniques, thus obtaining the benefits of each technology, i.e., range and precision. As the tool approaches a boundary of interest, the basis for steering decisions will progress from low-resolution measurements to high-resolution measurements, permitting high-accuracy borehole and casing placement without sacrificing the efficiencies gained by having long-range information available.

Figure 11:
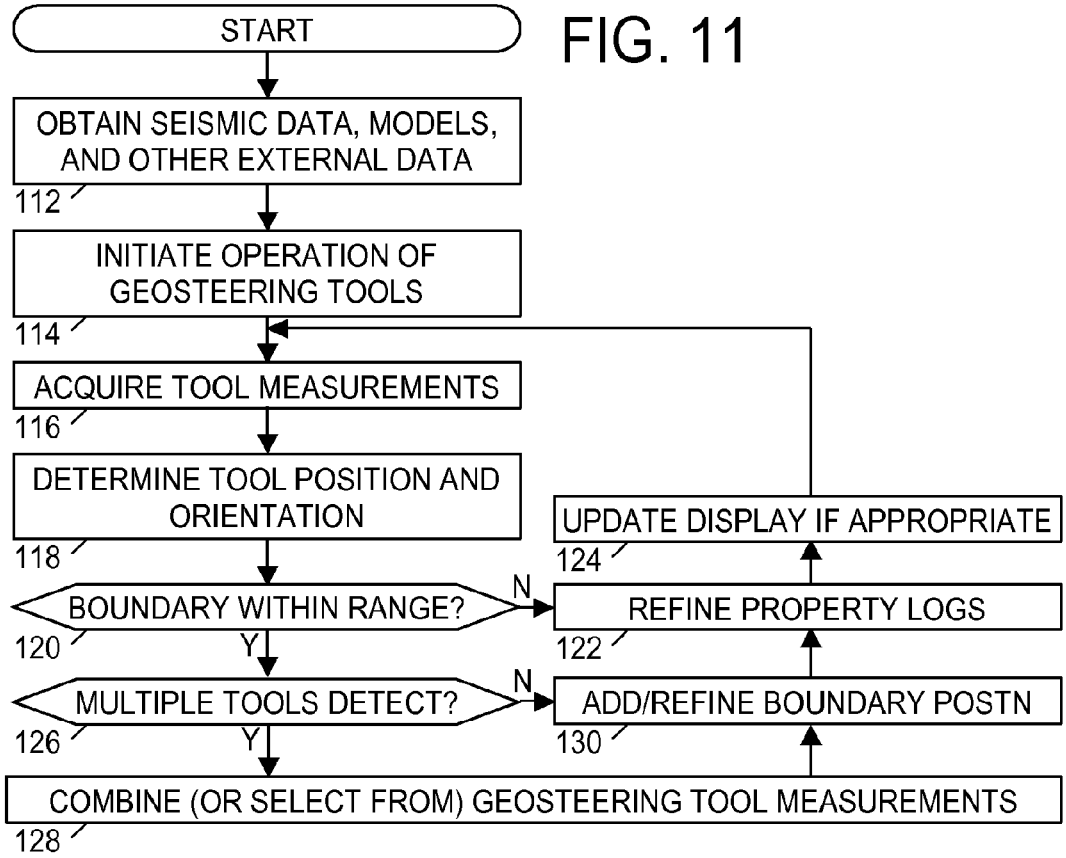
FIG. 11 is a flow diagram of an illustrative multimode geosteering method.

FIG. 11 is a flow diagram of an illustrative multimode geosteering method, which may be carried out by computer 38 alone or in combination with operations of a software-controlled processor in the downhole tool. In block 112, the computer obtains seismic data, formation models, and data from other sources external to the system. It is expected that a driller engaged in geosteering operations will have some data upon which to perform some initial well planning, e.g., the approximate location and characteristics of a bed that is believed to contain producible hydrocarbons. As another example, a bed may be of interest as an anchor point for a casing string. Such data may be obtained from seismic surveys, pilot wells, and/or geophysical modeling. The computer may display this data as a background image or data volume upon which the borehole path will be shown with data from the geosteering tool measurements.

In block 114, the system initiates geosteering tool operation. In some embodiments, the computer 38 has control over the tool's operating parameters, such as signal waveforms and frequencies, sampling rates, azimuthal sector sizes, data formats, etc. These parameters are set and the various transmitter-receiver arrangements for the different geosteering measurement types are engaged to start collecting and communicating measurements to computer 38.

In block 116, computer 38 receives measurements from the geosteering tool assembly, and in block 118, computer 38 determines the position and orientation of the tool. (As previously discussed, the bottom hole assembly includes instrumentation for measuring tool position and orientation.)

In some embodiments, the downhole tool preprocesses the tool measurements to reduce the required telemetry bandwidth. The preprocessing approaches may vary, but it is contemplated that the downhole tool will sum or average multiple measurements together to improve signal to noise ratio, and may further determine parameterized representations of the data to further compress the measurements into values of interest. In geosteering applications, it is expected that boundary detection will be of primary interest, and hence downhole tools may preprocess the data to detect and specify the relative position of boundaries. Such boundary information may be communicated to the surface in place of the raw data. Accordingly, the actions represented by blocks 120-122 and 126-130 can be performed downhole or by computer 38 or by different combinations thereof.

In block 120, the system analyzes the measurement data to determine if a boundary is in range of at least one of the geosteering measurement types. (A boundary can be identified by a gradient or discontinuity in the data that is consistent along at least one dimension.) If not, then in block 122, the measurement data is combined with previous measurements to extend or refine formation property logs (e.g., logs of acoustic slowness, resistivity, density, porosity, and permeability). In block 124, the computer 38 updates the display as necessary to reflect drilling progress and any changes to displayed formation properties and/or boundary locations. Thereafter additional measurements are collected in block 116.

If a boundary is detected within range of at least one of the geosteering measurement types, then in block 126, the system determines if the boundary can be detected by multiple measurement types. If so, then in block 128, the system combines or selects one or the boundary measurements. If the boundaries are determined to be the same, the relative boundary position (distance and direction) estimate can be improved by combining the boundary measurement information from the different measurement types. The position measurements may be averaged or a weighted sum may be performed. In some embodiments, the weighting coefficients are determined based on the measurement contrast, with higher weighting provided for the measurement type that measures the highest contrast across the boundary. In other embodiments, the weighting coefficients may be determined based on the known resolution of the different measurement types, with the higher-resolution measurement being more heavily weighted. In still other embodiments, the system simply selects the measurement type that offers the highest contrast or highest resolution from those measurement types that detect the boundary, and uses that measurement type to specify the distance and direction to the boundary.

In block 130, the boundary position measurement is used to add or refine the indication of a boundary at the appropriate position on the log and/or on the geosteering display. Then in block 122, the boundary position can be used to improve the formation property log estimates since such boundaries often influence tool measurements.

Though the method described above focuses on the case where a single boundary is detected, the method can be readily extended to cover situations where multiple boundaries are detected by some combination of the tools.

In some embodiments, the different geosteering measurements are used synergistically to refine the physical formation model, thereby improving measurement accuracy. For example, the acoustic measurements may provide azimuthally-sensitive invasion profile information that can be used to refine the resistivity measurements, thereby yielding more accurate boundary distance and direction calculations. The combination of acoustic and NMR measurements may offer insight into stress gradients that the driller can exploit to improve drilling speed and borehole longevity.

Moreover, because multiple measurement types are being employed, the tool performance is more robust. For example, in those regions where resistivity contrasts are low, the acoustic tool can carry the main burden for geosteering decisions. Conversely, where acoustic tools do not perform well, the resistivity tools can carry the burden, and the drillers still have enough information to operate efficiently.

Where two or more measurement types perform well, mismatches in boundary distance measurements may yield significant information. In some embodiments, the system identifies and highlights such mismatches for the user to view. Such mismatches may be indicative of fluid migration or potentially useful rock morphologies.

The geosteering systems and methods disclosed herein employ multiple measurement types for geosteering. In some embodiments, the tool employs azimuthally sensitive acoustic and resistivity measurements to detect nearby boundaries and enable steering relative to those boundaries. The acoustic measurements will have a longer range, while the electromagnetic measurements will have a higher resolution. In some variations, additional measurements having short ranges (e.g., nuclear magnetic resonance or gamma ray measurements) are also employed for even higher resolutions at shorter ranges. The tool measurements may be further combined with seismic data models covering significant portions of the reservoir at poor resolutions (e.g., 30 meter cubes).

Numerous variations and modifications will become apparent to those skilled in the art once the above disclosure is fully appreciated. It is intended that the following claims be interpreted to embrace all such variations and modifications.

What is claimed is:

1. A geosteering tool that comprises:

an acoustic transmitter-receiver arrangement that makes acoustic slowness measurements as a function of tool position, azimuth, and radial depth;

an electromagnetic transmitter-receiver arrangement that makes resistivity measurements as a function of tool position, azimuth, and radial depth; and a processing system that determines an acoustic boundary position based on the acoustic slowness measurements, determines a resistivity boundary position based on the resistivity measurements, and provides a displayed boundary position derived from a selection or combination of the acoustic and resistivity boundary positions.

2. The tool of claim 1, wherein the displayed boundary position is selected to be the boundary position based on a measurement type that provides a higher contrast.

3. The tool of claim 1, wherein the displayed boundary position is selected to be the boundary position based on a measurement type that provides a higher resolution.

4. The tool of claim 1, wherein the displayed boundary position is a weighted average of the acoustic and resistivity boundary positions with weighting coefficients based at least in part on the relative contrast detected by the different measurement types.

5. The tool of claim 1, wherein the displayed boundary position is a weighted average of the acoustic and resistivity boundary positions with weighting coefficients based at least in part on the relative resolution of the different measurement types.

6. The tool of claim 1, wherein the processing system determines a range for each measurement type and:

for remote positions outside the range of the acoustic measurements, displays boundary information derived from seismic survey data;

for intermediate positions inside the range of the acoustic measurements but outside the range of the resistivity measurements, displays boundary information based at least in part on acoustic measurements; and for innermost positions inside the range of both the acoustic measurements and the resistivity measurements, displays boundary information selected or combined from each different measurement type.

7. The tool of claim 6, wherein information for the remote, intermediate, and innermost positions is displayed with different shading, intensity, opacity, or resolution.

8. The tool of claim 1, wherein at least one element of the acoustic transmitter-receiver arrangement is positioned between elements of the electromagnetic transmitter-receiver arrangement.

9. The tool of claim 1, wherein at least one element of the electromagnetic transmitter-receiver arrangement is positioned between elements of the acoustic transmitter-receiver arrangement.

10. A geosteering method that comprises:

measuring acoustic slowness as a function of tool position, azimuth, and radial depth;

measuring resistivity as a function of tool position, azimuth, and radial depth;

determining a bed boundary position using measurements with different energy types, wherein said determining includes:

deriving an acoustic boundary position from the acoustic slowness measurements;

deriving a resistivity boundary position from the resistivity measurements;

obtaining the bed boundary position from a selection or combination of the acoustic boundary position and the resistivity boundary position; and adjusting a drilling direction based at least in part on said determination.

11. The method of claim 10, wherein said adjusting steers the borehole substantially parallel to the boundary.

12. The method of claim 10, wherein said combination is a weighted average of the acoustic and resistivity boundary positions.

13. The method of claim 12, wherein the weighted average uses coefficients based on measurement resolutions.

14. The method of claim 12, wherein the weighted average uses coefficients based on measurement contrast.

15. The method of claim 10, wherein the obtained bed boundary position is selected to be the boundary position based on a measurement type that provides a higher contrast.

16. The method of claim 10, wherein the obtained bed boundary position is selected to be the boundary position based on a measurement type that provides a higher resolution.

17. The method of claim 10 further comprising:

determining a range for each measurement type and:

for remote positions outside the range of the acoustic measurements, displaying boundary information derived from seismic survey data;

for intermediate positions inside the range of the acoustic measurements but outside the range of the resistivity measurements, displaying boundary information based at least in part on acoustic measurements; and for innermost positions inside the range of both the acoustic measurements and the resistivity measurements, displaying boundary information selected or combined from each different measurement type.

18. A geosteering system that comprises:

memory that stores geosteering display software; and a processor coupled to the memory to execute the software, wherein the software configures the processor to:

receive geosteering measurements of different types; and generate an image based on the geosteering measurements, wherein the image has a first region proximate the borehole path and a second region surrounding the first region, wherein the first region displays boundary positions based upon geosteering measurements of a first type, and the second region displays boundary positions based at least in part upon geosteering measurements of a second, different type.

19. The system of claim 18, wherein the different types of geosteering measurements are included in the set consisting of azimuthal acoustic slowness, azimuthal resistivity, azimuthal NMR measurements, and azimuthal gamma ray measurements.

20. The system of claim 18, wherein the image is three-dimensional.

21. The system of claim 18, wherein the first region is visually distinguished from the second region by at least one visual characteristic in the set consisting of opacity, resolution, and color intensity.

* * * * *

UNITED STATES PATENT AND TRADEMARK OFFICE

CERTIFICATE OF CORRECTION

PATENT NO. : 8,347,985 B2
APPLICATION NO. : 12/679502
DATED : January 8, 2013
INVENTOR(S) : Michael S. Bittar et al.

It is certified that error appears in the above-identified patent and that said Letters Patent is hereby corrected as shown below:

Title Page, Item (54) and in the specification, Column 1, line 1, title, the spelling of the word "Mulitmodal" is changed to "Multimodal".

Signed and Sealed this
Twenty-first Day of May, 2013

Teresa Stanek Rea
*Acting Director of the United States Patent and Trademark Office*